US011883727B2

(12) United States Patent
Poulin et al.

(10) Patent No.: US 11,883,727 B2
(45) Date of Patent: Jan. 30, 2024

(54) PORTABLE AND ADJUSTABLE TRAINING APPARATUS

(71) Applicants: Gregory James Brooks, Lilburn, GA (US); Nicholas Scott Knowles, Dunwoody, GA (US)

(72) Inventors: Gabriel Rainier Poulin, Atlanta, GA (US); Gregory James Brooks, Lilburn, GA (US); Nicholas Scott Knowles, Dunwoody, GA (US)

( * ) Notice: Subject to any disclaimer, the term of this patent is extended or adjusted under 35 U.S.C. 154(b) by 123 days.

(21) Appl. No.: 17/301,031

(22) Filed: Mar. 22, 2021

(65) Prior Publication Data

US 2021/0291029 A1 Sep. 23, 2021

Related U.S. Application Data

(60) Provisional application No. 62/992,605, filed on Mar. 20, 2020.

(51) Int. Cl.
*A63B 69/00* (2006.01)

(52) U.S. Cl.
CPC ..... *A63B 69/0048* (2013.01)

(58) Field of Classification Search
CPC ..... A63B 21/0004; A63B 21/00043; A63B 21/02; A63B 21/04; A63B 21/0407; A63B 21/0414; A63B 21/055; A63B 21/0552; A63B 21/0557; A63B 21/1469; A63B 21/1438; A63B 21/4033; A63B 21/4034; A63B 21/4035; A63B 21/4045; A63B 23/14; A63B 23/16; A63B 29/00; A63B 29/08
See application file for complete search history.

(56) References Cited

U.S. PATENT DOCUMENTS 3,268,225 A * 8/1966 Kolbel ..... A63B 21/00043 482/126
3,759,514 A * 9/1973 Cox ..... A63B 21/05 482/126
4,290,599 A * 9/1981 Berger ..... A63B 21/00069 482/126
4,333,645 A * 6/1982 Wu ..... A63B 21/00072 482/112
4,591,150 A * 5/1986 Mosher ..... A63B 21/1663 482/125
5,031,906 A * 7/1991 Jang ..... A63B 21/0552 482/125
D330,739 S * 11/1992 Yang ..... D21/693
(Continued)

*Primary Examiner* — Zachary T Moore

(57) ABSTRACT

The portable and adjustable training apparatus (also labelled as portable hangboard) is portable and can be attached to a fixed point of stabilization via the cord as desired for training purposes. It is freely moveable in that it can be transported to various locations or orientations for use. It is made up of a cylindrical shape in which a hollow core has a cord tied in a loop through the core. The cord is designed to travel through grooves/channels on the apparatus endcap resulting in the body to rotate to desired angle or position for training purposes. Attaching the cord to a fixed point allows the user to apply resistance on the body of the apparatus through the user's fingers resulting in the required resistance to train finger strength. The apparatus is used in training finger strength for sport and recreation.

2 Claims, 10 Drawing Sheets

(56) References Cited

U.S. PATENT DOCUMENTS

| | | | | |
|---|---|---|---|---|
| 5,637,066 | A * | 6/1997 | Chang | A63B 21/0004 482/121 |
| 6,926,747 | B2 * | 8/2005 | Udwin | A63B 23/12 482/121 |
| 7,465,259 | B2 * | 12/2008 | Mok | A63B 21/00185 482/121 |
| 8,152,697 | B2 * | 4/2012 | Wakuda | A63B 21/4049 482/126 |
| 10,076,678 | B2 * | 9/2018 | Sanseverino | A63B 21/154 |
| 11,033,774 | B1 * | 6/2021 | Clarke | A63B 21/00185 |
| 2011/0092346 | A1 * | 4/2011 | Wakuda | A63B 21/023 482/121 |
| 2020/0222755 | A1 * | 7/2020 | Adwan | A63B 21/00185 |

* cited by examiner

PORTABLE AND ADJUSTABLE TRAINING APPARATUS

CROSS-REFERENCE TO RELATED APPLICATIONS

This application claims the benefit of U.S. Provisional Application No. 62/992,605 filed Mar. 20, 2020.

STATEMENT REGARDING FEDERALLY SPONSORED RESEARCH

Not applicable

THE NAMES OF THE PARTIES TO A JOINT RESEARCH AGREEMENT

Not applicable

STATEMENT REGARDING PRIOR DISCLOSURES BY THE INVENTOR OR A JOINT INVENTOR

Not applicable

BACKGROUND OF THE INVENTION

Rock climbing training devices exist so that those looking to improve their finger and forearm strength can do so in a more efficient and effective way than only climbing rocks or man made climbing walls. These climbing training devices, also called hangboards, are materials of different shapes and sizes that consist of different climbing hold structures that are most commonly found while climbing on natural rock. Some of these training devices are portable because they are compact and lightweight and are installed by hanging it with a cord around something suitable.

A disadvantage of current portable hangboard designs is that there are tradeoffs between variety of hold structure, repeatability, hangboard length, and safety. Currently, in order to achieve compactness the variety of hold structures is limited to one or two different climbing hold structures. Another pitfall for some current portable hangboards is the way the cord is attached to the hangboard. Some designs allow the user to adjust the angle of the hangboard but give the user an infinite amount of adjustability within a finite range. This creates the problem of achieving repeatability (a metric for determining improvement) of an angle due to the human error aspect of estimating an angle to a previously used degree.

An example is the Flash Board by Tension Climbing which has one type of hold throughout that only varies in difficulty.

Another example is the Block, also by Tension Climbing, which has two types of hold variations and each block only accommodates one hand.

A third example is the Maxgrip by Max Climbing which uses a unique geometry to accommodate many different climbing holds. Like the block, each Maxgrip is made for one hand. In some instances, however, it is ideal to have one single portable hangboard long enough to accommodate two hands which due to the unique shape of the Maxgrip would make it bulky if elongated.

An example of a portable hangboard that does rotate 360 degrees is the RALLGRIP by Crampa. It does this in a way where the cord and the portable hangboard can separate from each other. At least two problems can occur with this design. 1.) The cord can become lost or left behind on accident and 2.) if the hangboard is used improperly and twists in a way where one end moves down and the other end moves up, the cord could detach from the hangboard and the user could fall unintentionally.

BRIEF SUMMARY OF THE INVENTION

Briefly described, and according to one embodiment, aspects of the present disclosure generally relate to devices for rock climbing training and/or fitness related thereto, and, more particularly, to a portable hangboard. As will be understood, a hangboard is a tool that climbers or other fitness enthusiasts may use to improve finger strength. In a typical hangboard workout, a climber places his fingers onto/into a grip/hold and hangs from the grip/hold. Different styles of grips/holds/structures allow for the climber to work out different grips for different fingers, with the goal of increasing finger strength.

In at least one embodiment, the portable hangboard includes a middle body connected to two end members (one end cap on each end of the middle body) by a gear system. In various embodiments, the middle body has different styles of structures/grips/holds around the outside of the middle body, so that when rotated, a user has access to different types of structures/grips/holds. In one or more embodiments, the portable hangboard middle body defines a hollow middle portion that extends through the length of the middle body. In some embodiments, the hangboard includes end members that define openings for a cord to be placed through the hollow middle and exit on the outside of the end members. In multiple embodiments, the cord may be one single, continuous loop, or may have two ends that are connected so that it forms a continuous loop. In some embodiments, the end members define channels/grooves on the outside of the end members, such that the cord can be placed into the channels/grooves, where each channel/groove corresponds to a different style of structures/grip/hold on the main body. In various embodiments, a user places the cord into a set of grooves/channels that correspond to a structures/hold/grip on the middle body, and the tension in the cord, which is created when the user hangs the cord slack, locks the portable hangboard in place so that the middle body cannot rotate while the user is using the hangboard.

In one embodiment, the cord may have a carabiner or another similar hanging mechanism that a user may use to hang the device onto a bar or another attachment point. In at least one embodiment, the user may wrap the carabiner around a bar and attach the carabiner back to the cord so that the cord is wrapped around the bar (or other suitable structure). In various embodiments, the user may use the cord to hang the device without any additional hanging mechanism, such as wrapping the cord around a bar and tying a knot with the cord (e.g., a cow hitch knot).

In multiple embodiments, the rotating middle body allows for a user to quickly access various types of structures/holds/grips in less time, thus making the user's workout more efficient.

DETAILED DESCRIPTION OF THE INVENTION

Figure 1:
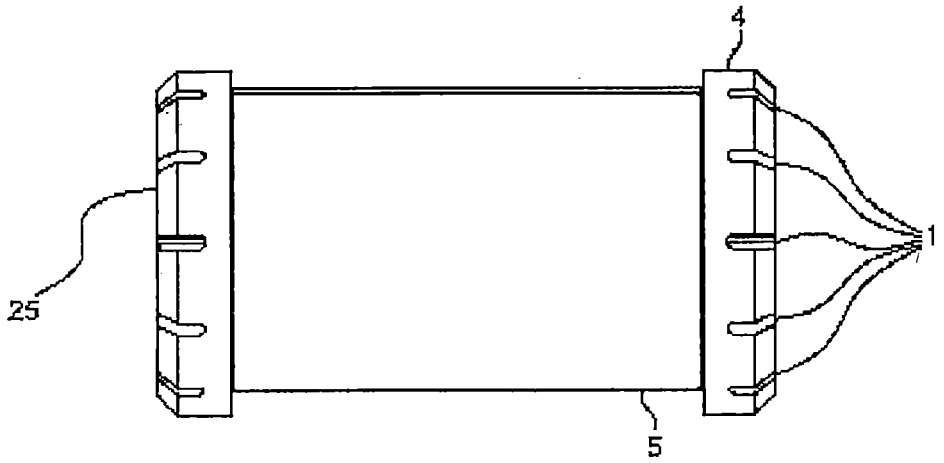
FIG. 1. is a side view of a portable and adjustable training apparatus according to one embodiment of the present disclosure.
Figure 2:
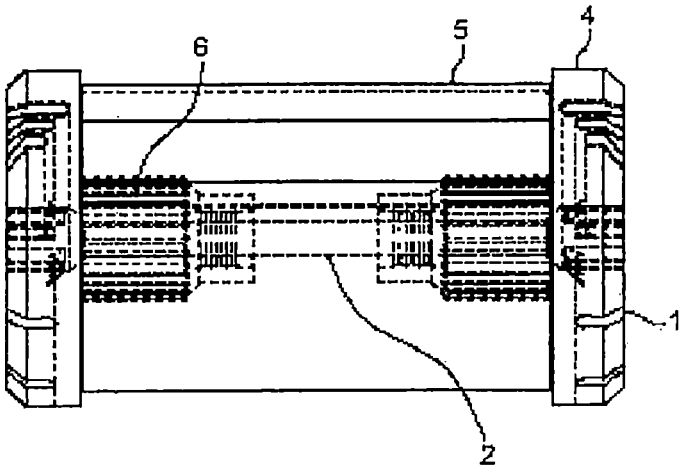
FIG. 2. is a side view of a portable and adjustable training apparatus according to one embodiment of the present disclosure.
Figure 3:
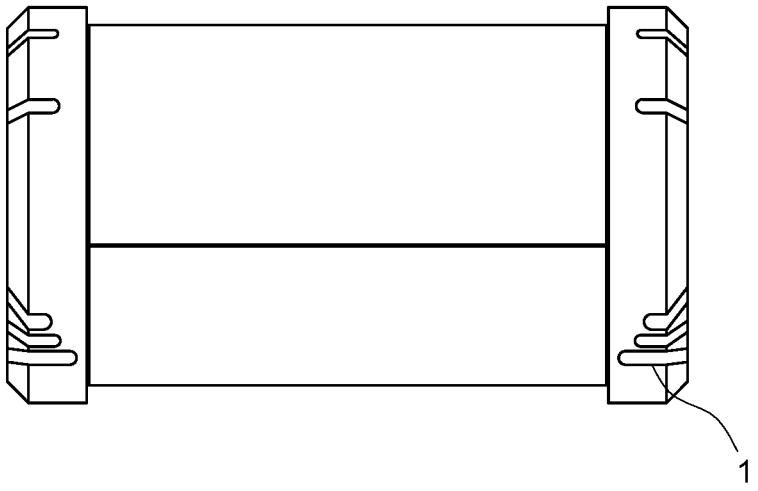
FIG. 3 is a side view of the portable and adjustable training apparatus of FIG. 1.
Figure 4:
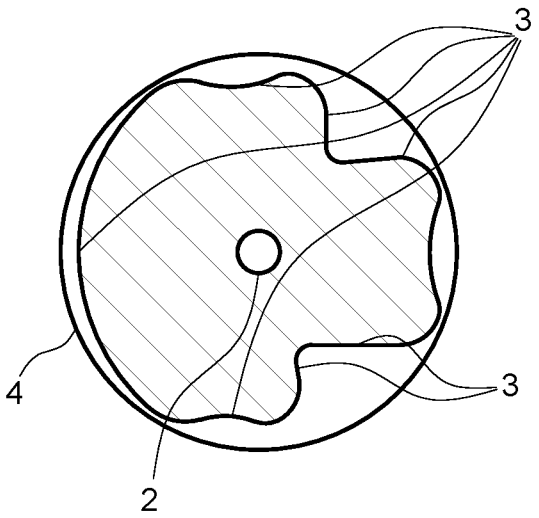
FIG. 4 is a sectional view of the portable and adjustable training apparatus of FIG. 1.
Figure 5:
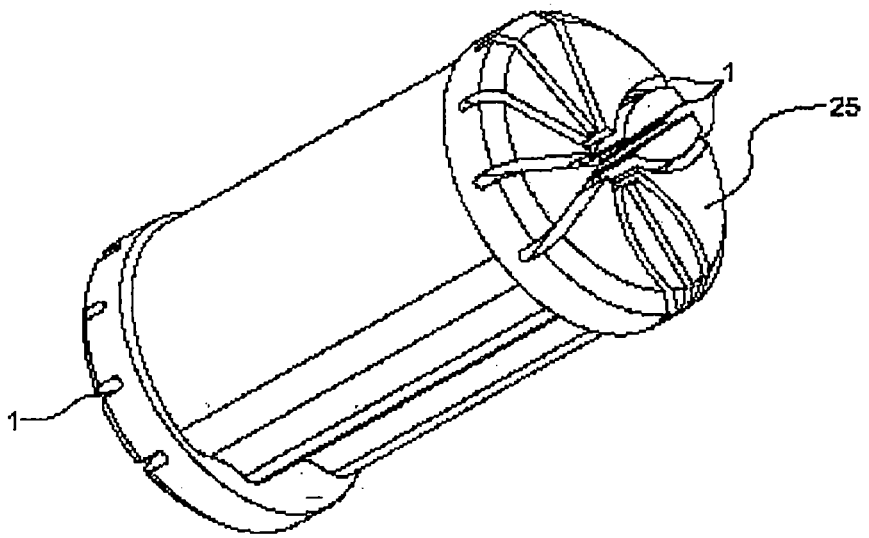
FIG. 5 is a side perspective view of the portable and adjustable training apparatus of FIG. 1.
Figure 6:
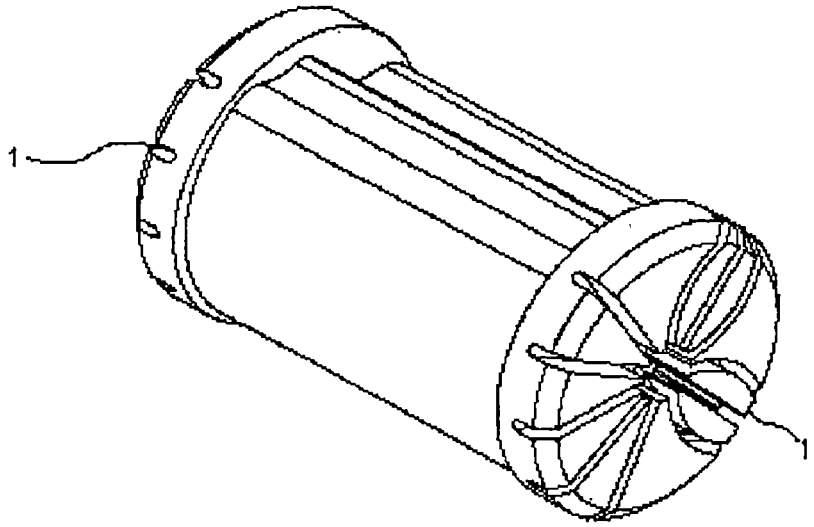
FIG. 6 is a side perspective view of the portable and adjustable training apparatus of FIG. 2.
Figure 7:
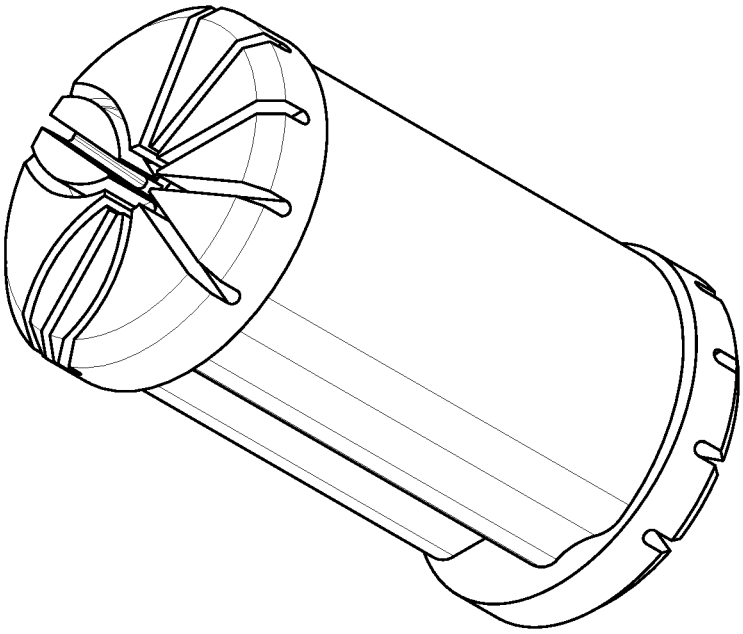
FIG. 7 is a side perspective view of the portable and adjustable training apparatus of FIG. 2.
Figure 8:
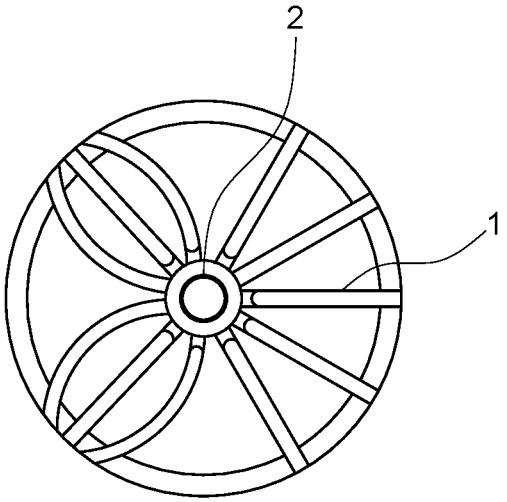
FIG. 8 is a side view of the portable and adjustable training apparatus of FIG. 1.

In various embodiments, the portable hangboard has a middle body 5 with end portions 25, wherein the middle body 5 has structures 3 that are associated with different types of grips or holds for users. In multiple embodiments, the middle body 5 is generally cylindrical (with different surface structures 3 for different grip or hold structures), and can rotate around a middle axis 16 so that the user may change the placement of the structures 3 relative to the user, allowing the user to change the angle of the structures 3 so that the user can work out different grips and fingers. In an alternative embodiment, the middle body 5 may be another suitable shape to incorporate different hold or grip structure 3. In some embodiments, the middle body 5 defines an opening 2 that allows for a cord 17 to pass through the middle body 5.

In one or more embodiments, the middle body 5 is operatively connected by one or more locking mechanisms to two end members 4, one end cap on each end of the middle body 5. In some embodiments, the one or more locking mechanisms allow the middle body 5 to rotate independently of the cord 17 and end members 4. In an exemplary embodiment, the one or more locking mechanisms may be gears 6. As will be understood from discussions herein, the gears 6, in one or more embodiments, enable the middle body 5 to rotate independently of the end members 4 and locks the middle body 5 at specific locations in relation to the notches of the end members 4 defining different grip/structures 3, depending on which notch the cord 17 passes through. In at least one embodiment, the gears 6 lock the middle body 5 in place in relation to the end members 4 and do not enable the middle body 5 to rotate in relation to the end members 4, such that the cord 17 location within the notches of the end members 4 defines the grip or hold structures 3, without further potential adjustment from a user.

In another embodiment, the one or more locking mechanism may be a pin, wherein the pin, when placed inside a pin hole, locks the middle body 5 in place. Further, in one embodiment, the middle body 5 or end members 4 may have a plurality of pin holes, where each pin hole corresponds to a specific area of the middle body 5, where a user inserts the pin into the pinhole that corresponds to the specific area of the middle body 5 that the user desires to use. In at least one embodiment, the one or more locking mechanism may be a combination of at least one pin and one or more gears 6, where the middle body 5 or an end cap has a pin hole, where a user can take the pin out of the pin hole, rotate the middle body 5 using locking gears 6, and, when the user has rotated the middle body 5 to the desired point, place the pin back in the pin hole, which locks the middle body 5 from rotating.

In one embodiment, the device may have end members 4 affixed to either end of the middle body 5, so that the end members 4 and middle body 5 rotate together, and may be locked in place together when the cord 17 is placed in the notches of the end members 4. For example, in some embodiments, the middle body 5 and the end members 4 may be integrally formed or fixed via an adhesive or other fixture.

Figure 9:
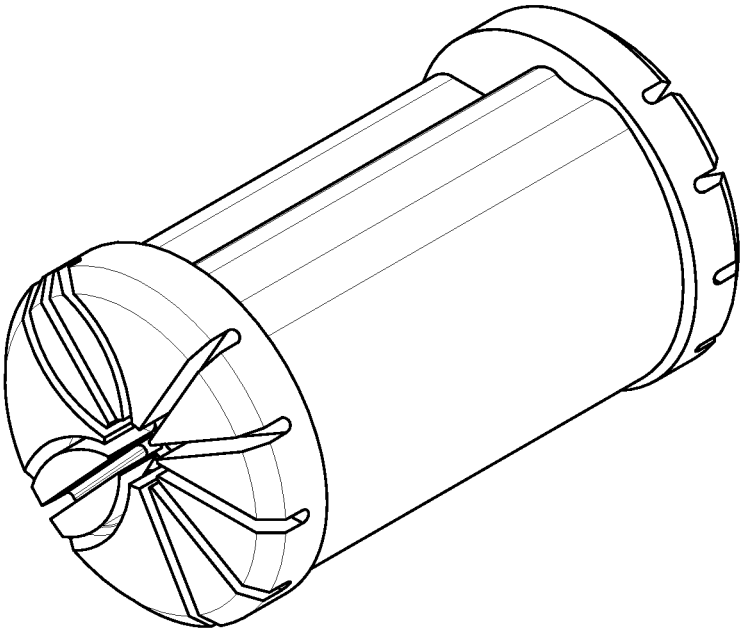
FIG. 9 is a side perspective view of a portable and adjustable training apparatus according to one embodiment of the present disclosure.
Figure 10:
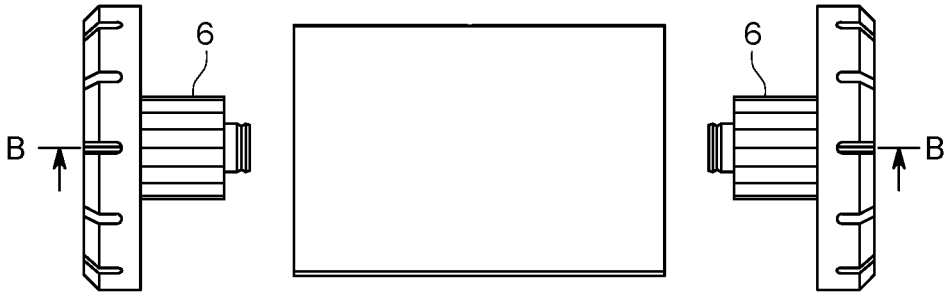
FIG. 10 is a side exploded view of the portable and adjustable training apparatus of FIG. 2
Figure 11:
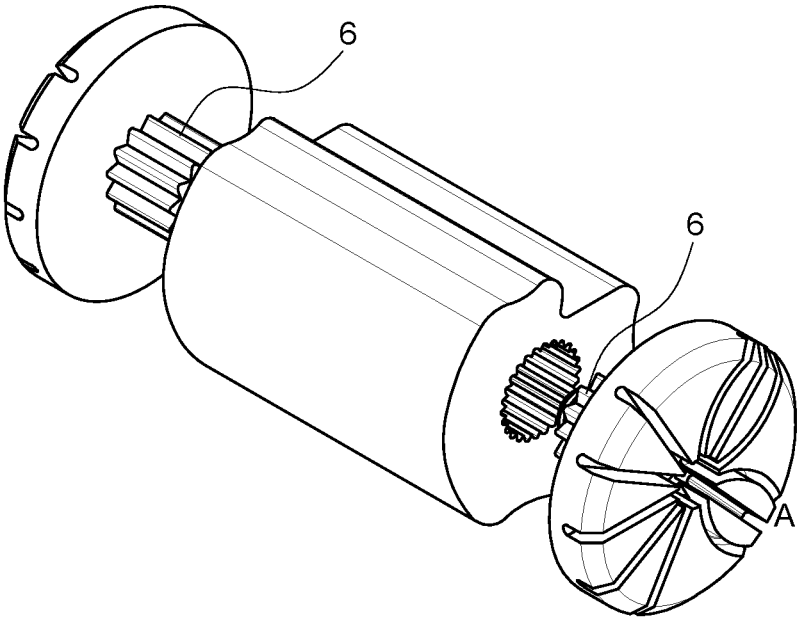
FIG. 11 is a side perspective exploded view of the portable and adjustable training apparatus of FIG. 2
Figure 12:
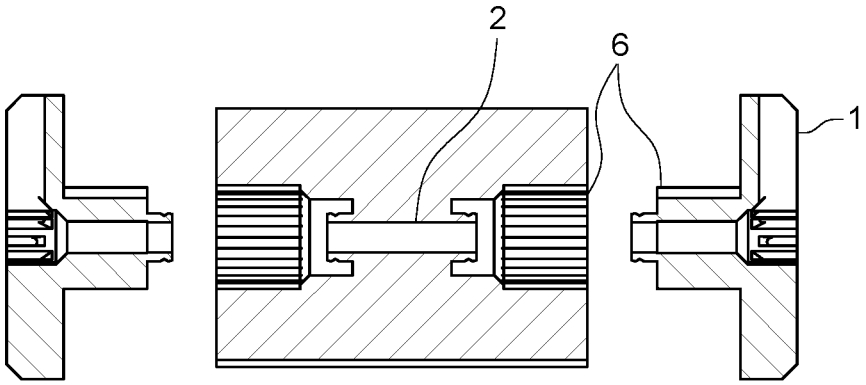
FIG. 12 is an exploded sectional view of the portable and adjustable training apparatus of FIG. 2

In another embodiment, the training devices may not have any end members 4 and instead have the notches 1 installed on the outward facing ends of the training devices so that the device is made out of one single material, such as wood, as shown in FIG. 9.

In multiple embodiments, the end members 4 are substantially circular or another suitable shape. In some embodiments, the end members 4 are the same shape as the ends of the middle body 5. In at least one embodiment, the end members 4 define an opening 2. In one embodiment, the opening 18 of the end members 19 allows for the cord 17 that passes through the middle opening 2 of the middle body 5 to further pass through the opening 18 of the end members 4. In one or more embodiments, the end members 4 have multiple notches 1 cut into or defined by the face of the end members 4. In various embodiments, one end of each of the multiple notches 1 is on the outer edge of the end cap 4 and the other end of each of the multiple notches 1 is on the edge of the opening 2 of the end members 4.

In several embodiments, one or more of the multiple notches 1 on an end cap is a curved shape. In at least one embodiment, two curved notches 1 may be located on either side of a straight notch 1, where the straight notch 1 may correspond to a hold or grip structure 3 that is parallel with the ground when the user hangs on the grip structure 3 and the curved notches 1 correspond to a positive or negative angle of the same grip structure 3, such that the same hold or grip structure 3 is not parallel to the ground but the user is still able to hang from the same hold or grip structure 3. In a further embodiment, the curvature of the curved notches 1 on either side of the straight notch 1 allows the cord 17 exits of the curved notches 1 to be relatively close in proximity to the cord 17 exit of the straight notch 1 while the space in between the notches 1 remains far enough apart so that the notches 1 will not break when the user is using the device with the cord 17 through the curved notches 1. For example, if the curved lines were straight, the openings 2 that correspond to the slight angle shills of the hold or grip structure 3 would be very close to each other (or overlapping), which would mean the walls between each notch 1 would be very thin, thus increasing the potential for breaking. In one embodiment, the end members 4 have mirror-image patterns of notches 1. In another embodiment, the notches 1 may not have any pattern, or the notches 1 may all be straight lines from the edge of the end members 4 to the middle opening 2 of the end members 4. In a further embodiment, only one end cap may have a plurality of notches 1.

In an alternate embodiment, the middle body 5 may implement a ratchet gear system that allows the middle body 5 to rotate in only one direction around the middle axis 16, so that a user can hang on the present device without the middle body 5 rotating. In this alternate embodiment, the user can choose which hold or grip structure 3 the user desires to hang from by rotating the middle body 5 around the middle axis 16 in only one rotational direction until the desired hold or grip structure 3 is at the desired position. Still in this alternate embodiment, when the user then hangs from the desired hold or grip structure 3, the ratchet gear system prevents the middle body 5 from rotating even though the user is applying a rotational force onto the middle body 5 by hanging on the middle body 5. Further, in this alternate embodiment, the cord 17 is not necessary to keep the middle body 5 from rotating.

In various embodiments, a user may rotate the middle body 5 and end members 4 around the cord 17 via the openings 2. In some embodiments, once the user has selected the configuration of the portable hangboard, the user puts the cord 17 through the notch 1 on each end cap that corresponds to the desired configuration. In at least one embodiment, once the cord 17 is securely in the notches 1, the user can hang the cord 17, wherein the tension from hanging the cord 17 locks the portable hangboard in place so that the middle body 5 cannot rotate while the user is using the hangboard. In one embodiment, the cord 17 may have a carabiner or some other similar hanging mechanism that a user may use to hang the device onto a bar or some similar attachment point, or wrap the carabiner around a bar and attach the carabiner back to the cord 17 so that the cord 17 is wrapped around the bar. In another embodiment, the user may use the cord 17 to hang the device without any additional hanging mechanism, such as wrapping the cord 17 around a bar and tying a knot with the cord 17 (e.g., a girth hitch).

According to particular embodiments, the present hangboard includes structures 3 spread 360 degrees around a single axis 16 such that the notches 1 correspond to different holds or training structures 3. In at least one embodiment, the cord 17 and notch 1 system allows for quick and easy rotational adjustments when the cord 17 is taken out of the notches 1 and a secured/locked position when the cord 17 is inserted into the notches 1.

The present device, in various embodiments, includes defined hold or grip structure 3, which can provide repeatable or substantially repeatable metrics for measuring growth, which is superior to previous designs with an infinite amount of angles. As will be understood, an infinite amount of angles would require a user to guess (e.g., "eye ball") whether they are using the same angle as before, which could lead to a lack of repeatability.

In multiple embodiments, the present device is superior to previous designs because the previous designs are more cumbersome and take the user a longer time to change grips.

In some embodiments, the mechanism that allows the middle body 5 to rotate independently of the end members 4 allows for the cord 17 to be kept in one notch 1 while still being able to rotate the middle body 5 360 degrees to access the structures 3. In various embodiments, the present device offers an advantage over previous designs because a user can rotate the middle body 5 to the desired structure 3 by simply taking the cord 17 out of the notch 1, rotating the device (middle body 5 and end members 4) and inserting the cord 17 into the corresponding notch 1. In one embodiment, if a cord 17 exits a notch 1, the gearing or locking mechanisms may release the middle body 5, allowing the middle body 5 to rotate. In at least one embodiment, the gearing or locking mechanisms include one or more magnets that engage when the cord 17 is taut, locking the middle body 5 in a particular location. In an alternate embodiment, the gearing or locking mechanism might include friction, a snap, or a pin and hole.

Figure 13:
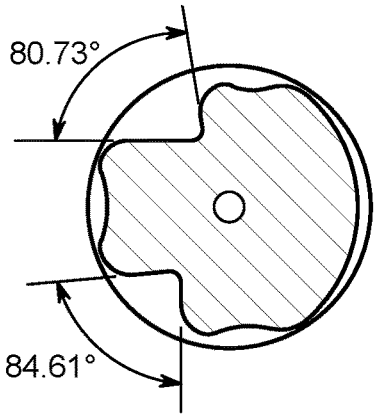
FIG. 13 is a sectional end view of the portable and adjustable training apparatus of FIG. 1.

In various embodiments, the middle body 5 incorporates two dimensional planes in some structures 3, where the structures 3 with two dimensions share an axis 16 and are separated by an angle between 45 degrees and 125 degrees (see FIG. 13). In some embodiments, using two dimensional planes in the design of the present device is superior to previous designs because previous designs have different sized edges that reside on planes that are parallel to each other, which is not spatially efficient. In multiple embodiments, the two dimensional planes allow for a more compact design of the present device and, thus, makes the present device more easily packable and storable.

The list below references the labels of FIG. 14:

12. An edge styled hold
13. An edge styled hold
14. An edge styled hold
15. An edge styled hold
8A. Beginning point to edge 12
8B. Exit point, of the straight notch 1 that corresponds to edges 12 and 13, that is measured to 8A
9A. Beginning point to edge 13
9B. Exit point, of the straight notch 1 that corresponds to edges 12 and 13, that is measured to 9A
10A. Beginning point to edge 14
10B. Exit point, of the straight notch 1 that corresponds to edges 14 and 15, that is measured to 10A
11A. Beginning point to edge 15
11B. Exit point, of the straight notch 1 that corresponds to edges 14 and 15, that is measured to 11A
16. The center axis 16 going through the body long ways.

Figure 14:
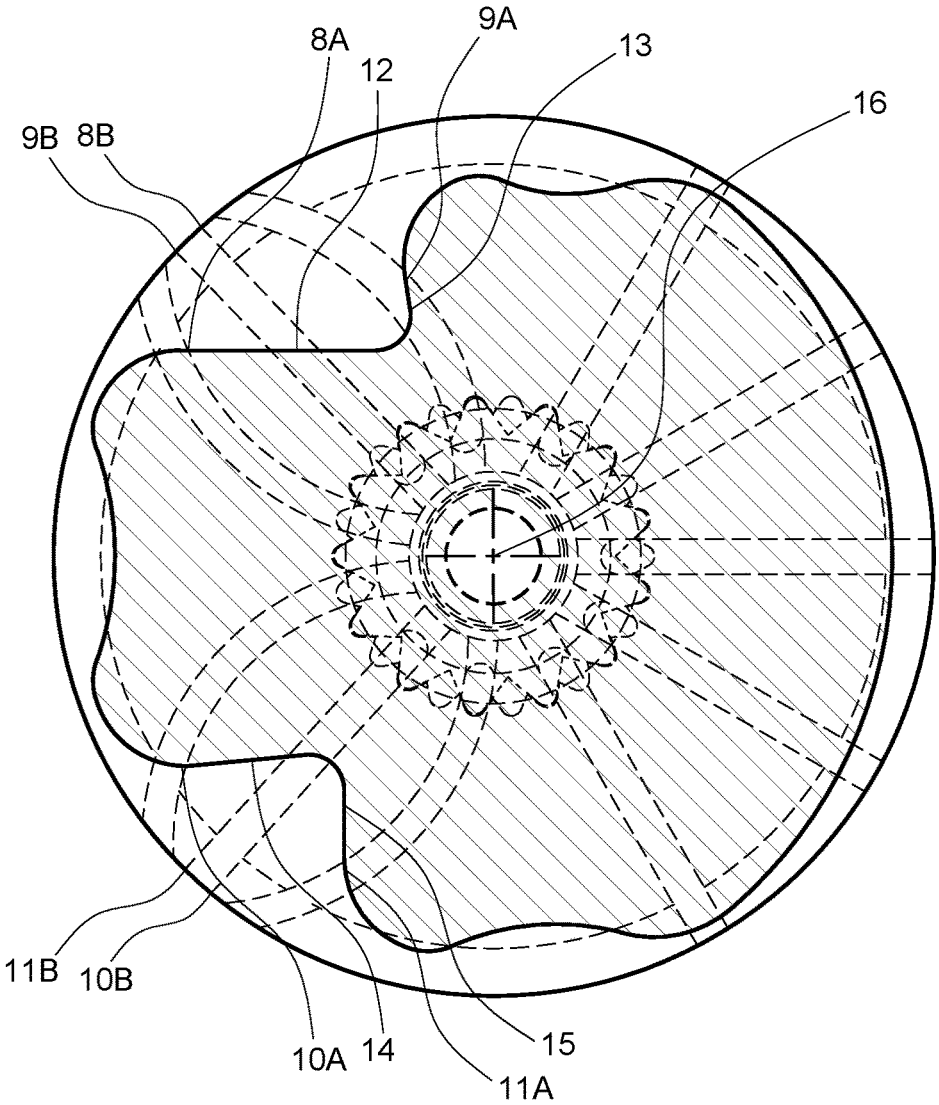
FIG. 14 is a sectional end view of the portable and adjustable training apparatus of FIG. 2.
Figure 15:
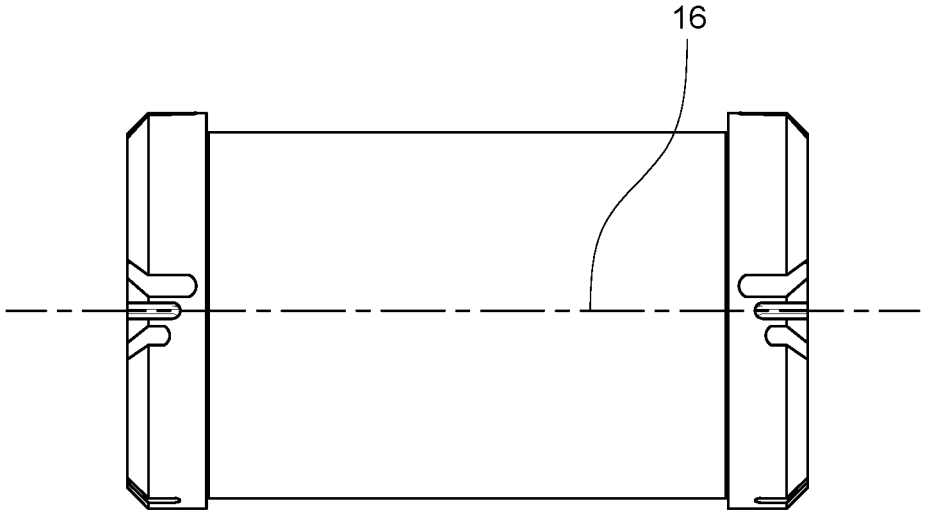
FIG. 15 is a side view of the portable and adjustable training apparatus of FIG. 1.
Figure 16:
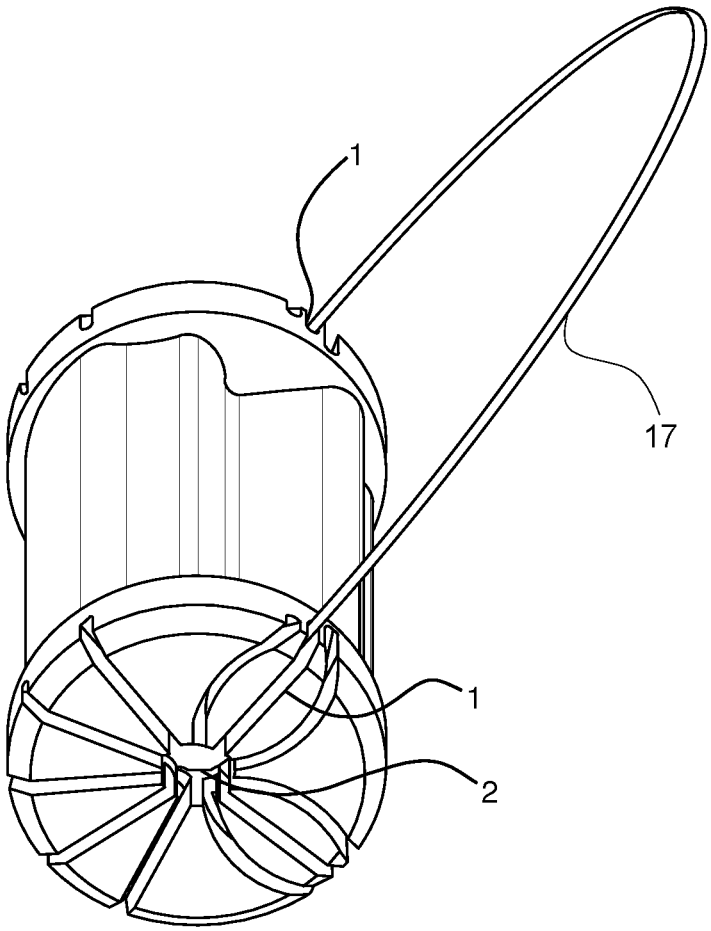
FIG. 16 is a perspective view of the portable and adjustable training apparatus of FIG. 1 with a cord depicted going through the apparatus and a set of notches on the ends.
Figure 17:
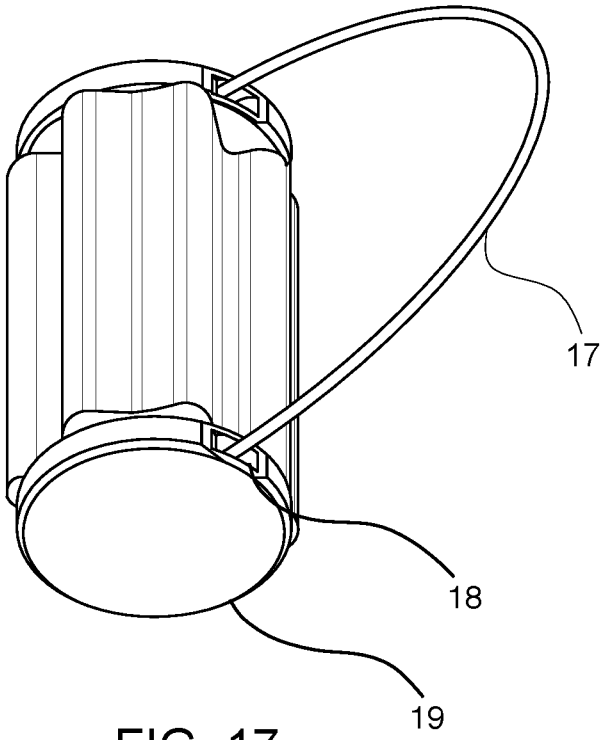
FIG. 17 is a perspective view of a portable and adjustable training apparatus according to one embodiment of the present disclosure depicted with a cord going through the apparatus and out of an opening on the end members.
Figure 18:
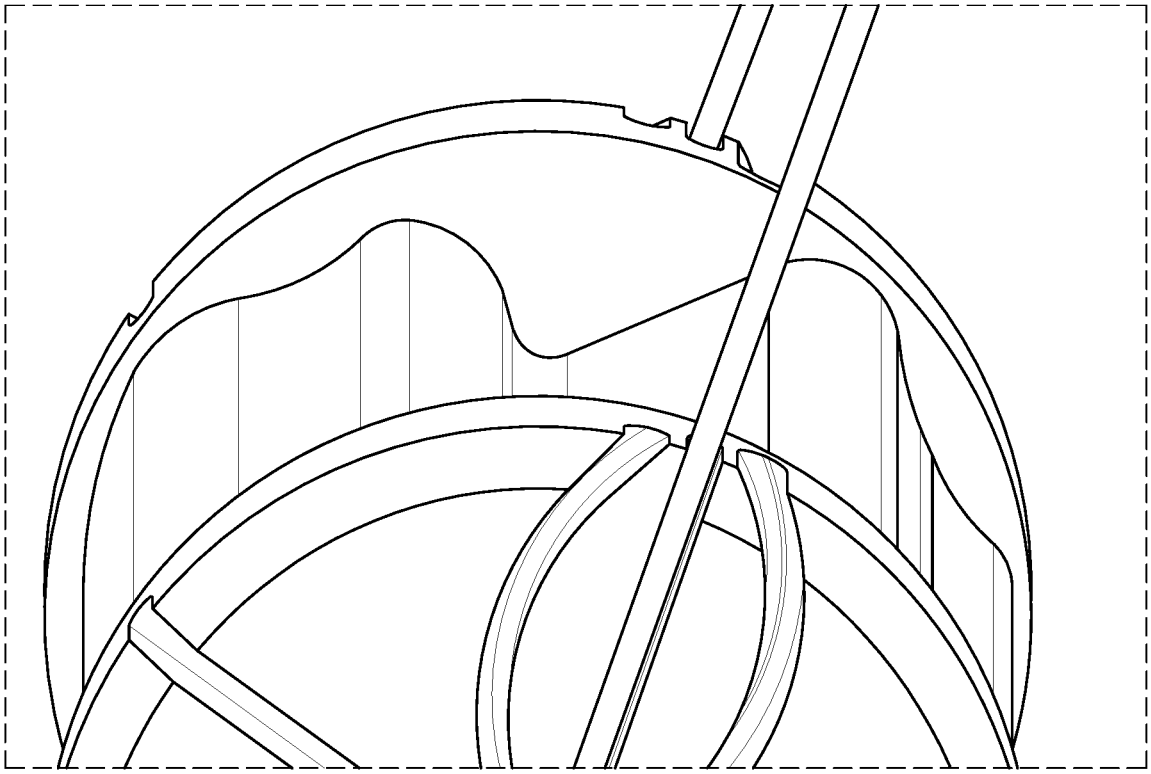
FIG. 18 is an enlarged perspective view of a portable and adjustable training apparatus of FIG. 1 depicting a cord in a notch on the end of the apparatus.
Figure 19:
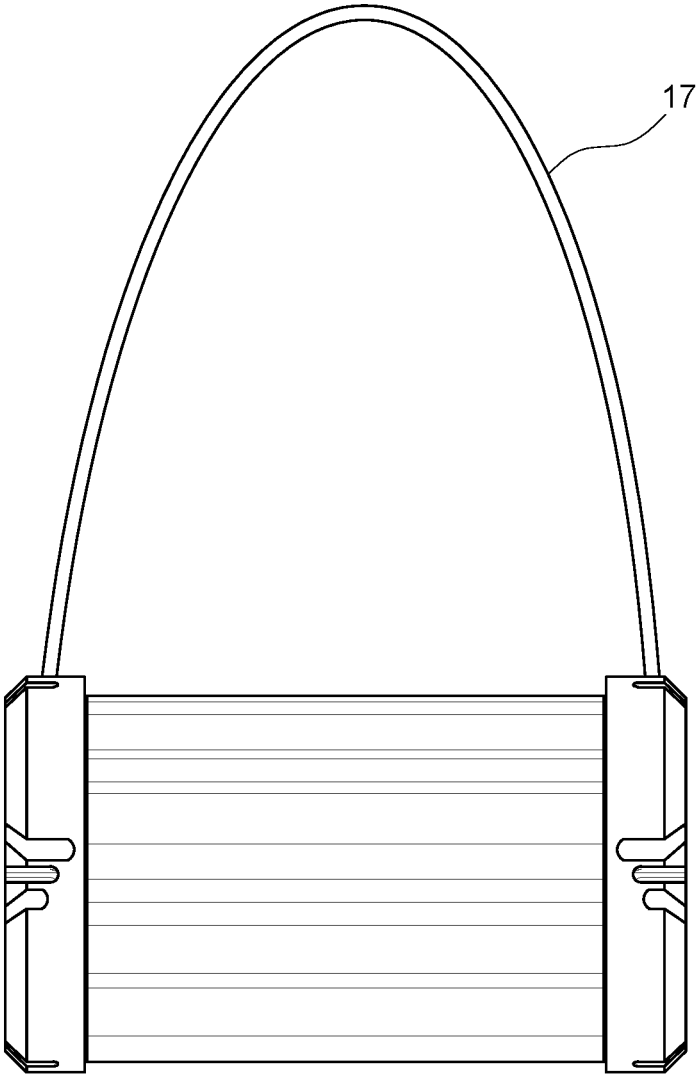
FIG. 19 is a side view of a portable and adjustable training apparatus of FIG. 1 depicting a cord running through the apparatus and coming out the notch opening on the edge of the end of the apparatus.

In various embodiments, the device may have edge holds 12, 13, 14, 15 (as shown in FIG. 14), where each edge hold 12, 13, 14, 15 has a specific point where the substantially flat portion of the edge hold 12, 13, 14, 15 begins (hereinafter "beginning point of the edge," as shown in FIG. 14 as 8A, 9A, 10A, and 11A). In multiple embodiments, the beginning point of the edge may be a specific perpendicular vertical distance from the corresponding notch 1 exit point (as shown in FIG. 14 as 8B, 9B, 10B, and 11B, where 8A corresponds to 8B, etc.). In several embodiments, the specific perpendicular vertical distances from the beginning points of the edges to the corresponding notch 1 exit points may be between 0.5 millimeters and 2.3 millimeters. In at least one embodiment, the specific perpendicular vertical distance range of 0.5 millimeters to 2.3 millimeters allows for different sized edge holds 12, 13, 14, 15 to be oriented substantially horizontally (+/−7 degrees from horizontal), which may be ideal for an edge hold 12, 13, 14, 15, as a person having ordinary experience in the field would understand. As an example, in one embodiment, in FIG. 14, the beginning point of the edge 8A, which is where edge 12 begins, has a perpendicular vertical distance from exit point 8B of 1.96 millimeters, where the distance is perpendicular to the substantially flat edge 12.

What is claimed is:

1. A climbing training device comprising:

a middle body having a first end portion and an opposite second end portion that encompasses at least one climbing hold structure for the use of training between the first and second end portions;

a plurality of end members attached to the first and second end portions that guide at least one flexible elongated member, that is used to attach the device to a bar, along the first and second end portions of the middle body;

the end members being attached to each first and second end portions in such a way that the middle body can rotate independently of at least one end member of the plurality of end members and the at least one flexible elongated member;

at least one locking mechanism that when engaged fixes the at least one end member from rotating independently of the middle body, whereby giving a user the ability to define the location of the at least one flexible elongated member relative to the at least one climbing hold structure encompassed in the middle body; and, wherein the locking mechanism is a gearing mechanism that when engaged fixes the at least one end member from rotating independently of the middle body.

2. A climbing training device comprising:

a middle body having a first end portion and an opposite second end portion that encompasses at least one climbing hold structure for the use of training between the first and second end portions;

a plurality of end members attached to the first and second end portions that guide at least one flexible elongated member, that is used to attach the device to a bar, along the first and second end portions of the middle body;

the end members being attached to each first and second end portions in such a way that the middle body can rotate independently of at least one end member of the plurality of end members and the at least one flexible elongated member; and, at least one locking mechanism that when engaged fixes the at least one end member from rotating independently of the middle body, whereby giving a user the ability to define the location of the at least one flexible elongated member relative to the at least one climbing hold structure encompassed in the middle body; and, wherein the locking mechanism is a ratcheting mechanism whereby allowing the user to rotate the middle body in one direction, relative to the end members, but locking up when being forced to rotate the other direction.

* * * * *